United States Patent [19]

Svensson

[11] Patent Number: 5,033,147

[45] Date of Patent: Jul. 23, 1991

[54] BRIDGE DECK

[76] Inventor: Lars D. Svensson, Vikingavägen 112, S-183 72 Täby, Sweden

[21] Appl. No.: 435,384

[22] PCT Filed: May 20, 1988

[86] PCT No.: PCT/SE88/00268

§ 371 Date: Nov. 29, 1989

§ 102(e) Date: Nov. 29, 1989

[87] PCT Pub. No.: WO88/09413

PCT Pub. Date: Dec. 1, 1988

[30] Foreign Application Priority Data

May 20, 1987 [SE] Sweden ..... 8702098

[51] Int. Cl.[5] ..... E01D 19/12

[52] U.S. Cl. ..... 14/73; 52/588

[58] Field of Search ..... 14/1, 3, 4, 6, 13, 14, 14/17, 73, 74; 52/578, 579, 580, 588, 586, 630, 731; 404/82; 428/457, 515

[56] References Cited

U.S. PATENT DOCUMENTS

| | | | |
|---|---|---|---|
| 2,330,365 | 9/1943 | Jackson | 428/457 |
| 2,457,129 | 12/1948 | Collings | 52/630 |
| 2,615,820 | 10/1952 | Schwoegler | 428/457 |
| 3,008,387 | 11/1961 | Wittenwyler et al. | 427/136 |
| 3,035,939 | 5/1962 | Edwards | 428/457 |
| 3,100,556 | 8/1963 | De Ridder | 189/34 |
| 3,128,851 | 4/1964 | De Ridder | 189/34 |
| 3,152,669 | 10/1964 | Johnston | 52/588 |
| 3,301,147 | 1/1967 | Clayton et al. | 52/588 |
| 3,308,595 | 3/1967 | Markow | 52/579 |
| 3,385,182 | 5/1968 | Harvey | 52/588 |
| 3,438,076 | 4/1969 | Sedlacek | 14/1.4 |
| 3,555,762 | 1/1971 | Costanzo, Jr. | 52/588 |
| 3,733,767 | 5/1973 | Craik | 52/529 |
| 4,392,335 | 7/1983 | Heiman | 404/82 |

FOREIGN PATENT DOCUMENTS 1090700 10/1960 Fed. Rep. of Germany .

*Primary Examiner*—Ramon S. Britts
*Assistant Examiner*—Gay Ann Spahn
*Attorney, Agent, or Firm*—Shapiro and Shapiro

[57] ABSTRACT

An arrangement in a bridge deck and the like surface-forming structure to be subjected to mobile concentrated loads of small extent, so-called point loads, moving along the bridge deck, comprises a plurality of neighboring elongate units, so-called deck slabs (1), supported by and anchored to a base in the form of beams or like supporting system (25), the units or slabs (1) being provided with a tongue (8) and groove (9) adapted to laterally join neighboring units. The groove (9) and tongue (8) are located in such manner relative to the unit or slab portions engaging with the base that when the units are positioned on the base (25), at least portions of a first edge part of each unit are directly supported by and anchored to the base, while, by the groove/tongue engagement, an opposite second edge part is supported by the first edge of the neighboring unit, which is directly supported by the base.

19 Claims, 3 Drawing Sheets

Fig. 2
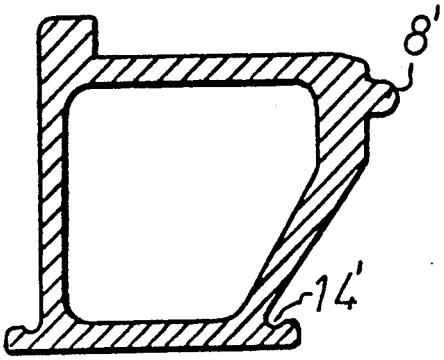
Fig. 3
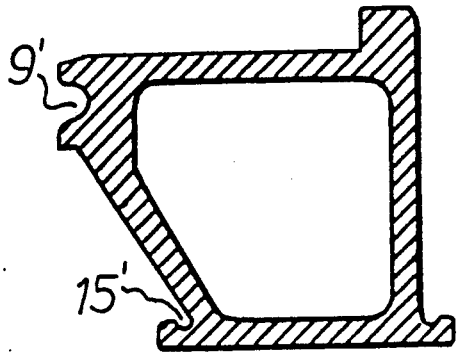
Fig. 4
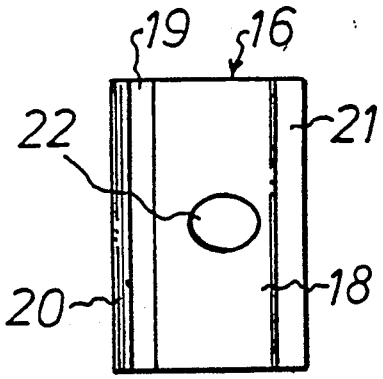
Fig. 5
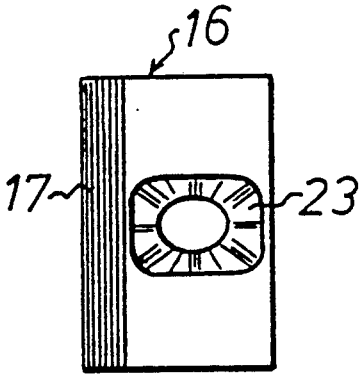
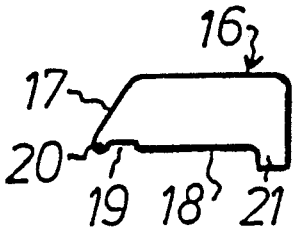
Fig. 6

BRIDGE DECK

BACKGROUND OF THE INVENTION

The present invention relates to a bridge deck of the type used to support mobile concentrated loads, as for example, in roadway systems.

Most bridges, particularly beam bridges, comprise a bridge deck supported by underlying beams. Frequently, this bridge deck is a concrete deck resting on longitudinal and, in some cases, transverse beams. A conventional concrete bridge deck is exceedingly heavy—the weight per $m^2$, including the asphalf wearing surface, amounts roughly to 700 kg—and is manufactured in a time-consuming manner. In the past few years, a great many bridges were found to be severely damaged, mainly by winter-time salting, and in need of reconstruction. Reconstruction of a bridge with a concrete deck means that the bridge must be closed, wholly or partly, for a very long period. Light bridges are sometimes provided with a deck of planking which in its entirety can be supported by secondary beams or the like. Wooden decks have a relatively short life and must be reconstructed time and again.

SUMMARY OF THE INVENTION

The object of the present invention is to provide a completely new type of bridge deck which is very light and is easily laid in both new constructions and reconstructions and when reconditioning, and which has a life far exceeding that of currently available bridge decks. A further object is to provide a bridge deck surfacing having a life which is many times longer than that of the present-day surfacings.

The characteristic features of the new bridge deck are stated in the appended claims.

The inventive bridge deck is preferably made by extrusion of aluminum or like light-alloy metal, whereby it is possible, in a practical manner, to obtain units with insignificant tolerance variations and considerable torsional strength.

To date, light metal, in particular aluminium, has been used but to a limited extent in bridge constructions, and one of the main reasons is that aluminium meets with fatigue failure more easily than e.g. steel, when subjected to pulsating loads. Especially in a bridge deck, the transverse units are subjected one after the other to the load of a passing vehicle, and this causes the units to move relative to one another, no matter how firmly they are affixed to the supporting base. The critical points thus are the joints between the units, where considerable stress occurs when a load leaves one unit and moves to the next. Previous attempts at solving this problem by means of tongue and groove arrangements have been unsuccessful.

The invention is based on the insight that the units or bridge deck slabs must be arranged such that any relative movement in the joints between the slabs is eliminated, and this constitutes an essential feature of the invention.

According to the invention, the units or slabs forming the bridge deck are in fact designed such that one side of each slab is rigidly supported by underlying beams or the like, whereas the opposite side is supported by the rigidly supported side of the neighboring unit. This is achieved in that the bridge deck slabs are provided with a special type of tongue and groove and are anchored to a load-bearing structure so as to guarantee the engagement between the tongue and groove. To achieve such anchoring which is to prevent any play between the bridge deck slabs and the structural beams, the point of engagement of the bridge deck slabs and also the attachment member must be designed in a special manner. To this end, a projecting of the bridge deck slab is provided with an upwardly open channel with which a complementarily designed portion of an attachment member attachable by leverage, as by means of a screw, is adapted to engage so as to press the lower side-edge of the slab against the base with great force.

To guarantee the engagement of the tongue and groove arrangement, the slabs must be pulled closely together in transverse direction. During extrusion, the material may be bent to a certain extent, and this must be accommodated during mounting. To this end, the attachment member is provided with a noncircular hole which allows adjustment after initial tightening of the screw joint in that the shank of the screw is used as an abutment for a wedge member inserted between the shank and the edge of the slab. When the correct position has been reached, the screw joint is tightened permanently.

Bridge decks are usually provided with a surfacing which, for the bridge deck according to the invention, is a special type of coating. To facilitate the use of a particularly thin coating, the bridge deck slabs are slightly bevelled along their upper abutting edges.

The coating of the bridge deck according to the invention is made up of a layer of primer applied directly to tha aluminium surface, a layer of permanently elastic plastic material, acrylic plastic or the like having a thickness of about 1–2 mm and, upon this, a layer of substantially rigid, i.e. somewhat flexible, plastic material, acrylic plastic or the like bonded to said permanently elastic material and having a thickness of about 3–10 mm and, finally, a hardwearing granulated mineral interspersed in the rigid material before this has set so that the granulated material will be firmly bonded therein.

When a vehicle is passing, bending motions arise in the coating and also in the deck slabs. These motions are absorbed in the permanently elastic layer, but in order to eliminate the risk that any changes in the angular relationship between the joints to the units become so great that the rigid layer fractures, the above-mentioned bevelling is provided which gives a deeper layer of permanently elastic material precisely at the joints, which can yield and allow deformation by a larger radius than the rigid material without breaking. The coating layer as described is completely tight and protects the underlying bridge deck effectively from water, salt and the like. Even if the rigid surface layer should be damaged, for example during snow clearing, or owing to an excessive change in the angular relationship between the joints, the permanently elastic layer adhering to the bridge deck and serving as a sealing compound ensures that no water can leak in.

Even though the inventive bridge deck is very strong, there may be situations when one or more bridge slabs must be replaced. The described structure with the tongue and groove portions which have a close fit and are positioned close to the upper surface of the bridge deck, renders it possible to tilt one or more bridge slabs in a simple manner, after the attachments have been loosened, and then to replace them by new slabs.

BRIEF DESCRIPTION OF THE DRAWINGS

The invention will be described in greater detail below, reference being had to the accompanying drawing in which:

FIGS. 2 and 3 are cross-sectional views of end sections for connecting with the bridge deck slabs;

FIGS. 4, 5 and 6 illustrate an attachment member for attaching the bridge deck slabs and the end sections to the structural beams, as seen from above, from below and from one end, respectively.

DESCRIPTION OF THE PREFERRED EMBODIMENTS

Figure 1:
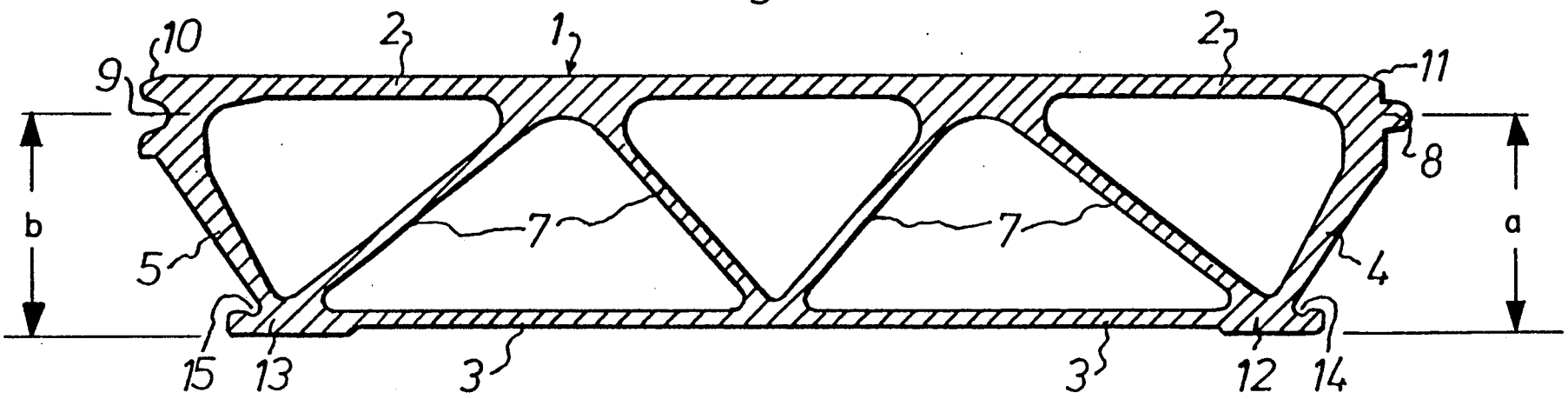
FIG. 1 is a cross-sectional view of a bridge deck slab for use in the bridge deck according to the invention.

The bridge deck slab 1 shown in FIG. 1 comprises an upper wall 2, a lower wall 3, side walls 4 and 5 and internal brace walls 7. "Junctions" are formed by material thickenings where the walls converge. Each of side walls 4 and 5 includes a portion which is substantially perpendicular to the upper wall, and there one side wall is provided with a tongue 8 having a rounded outer edge, and the other with a groove 9 with rounded extremities and a rounded bottom. The joint between the upper wall and the side walls is bevelled, as shown at 10 and 11.

The side walls 4 and 5, which have their thickest portions adjacent the upper wall and are inwardly inclined below the perpendicular portions and tapering, converge with the bottom wall 3 and respective brace walls to respective lower junctions. From these junctions there project; flush with the lower wall strips 12 and 13, respectively, which are provided with channels or grooves 14 and 15, respectively, having a rounded bottoms adjacent the respective side walls.

The height of the bridge deck slab at its opposite sides as counted from the somewhat thickened edges at the bottom wall to the center of the tongue 8 and groove 9, i.e. the heights designated a and b, respectively, differs. One height is slightly lower, the difference being between 0.1 and 0.4 mm. It is per se possible to choose which height is to be the lower one; the only condition is that all slabs in a series are made in the same manner. In the embodiment preferred, the height b of the side having the tongue is lower than the height of the grooved side (a). This means that when two slabs lie close together on a beam, the tongue 8 will be positioned somewhat lower than the groove 9, and when the slabs are pressed together, the bottom edge at the tongue side will be slightly raised from the beam surface. When the slabs have been fixed in the manner described below, stresses acting on the "tongue side" of one slab will be transferred via the tongue and groove to the grooved side of the neighboring slab and, via the side wall 5 thereof, to the supporting beam. Consequently, a row of bridge deck slabs mounted together as described will act as a unit, because the successive stresses are not gradually transferred from one slab to the next.

To achieve the desired interaction, the bridge deck slabs must be safely fixed, both mutually and relative to the base, and for this purpose use is made of the attachment members 16 as shown in FIG. 4 et seq. The attachment member comprises a metal body having an inclined side 17 with substantially the same inclination as the slab side walls, and a lower side 18 provided with a longitudinal recess 19 spaced from one edge such that a remaining rounded ridge 20 is formed at one edge of the inclined side. The rounded ridge is complementary to the channels 14 and 15, respectively, in the strips 12 and 13, respectively, of the slab 1. Along the opposite edge of the lower side, there is formed a downwardly extending projection 21. An elongate bore 22 extends transversely of the ridge 20 and the projection 21 and through the attachment member body, and a countersunk portion 23 for a screw head is formed in the upper side around the bore. The bridge deck slab is preferably fixed by means of attachment members 16 only along side.

This being the grooved side in the illustrative embodiment. However, as shown in the drawing, channeled strips (i.e., strips 12 and 13) are arranged at both the tongue and groove sides of the slab. The reason for this is that in some cases (as, for example) in certain types of bridges where a slab is used instead of an end section), it may be necessary to secure both sides of a slab. If, in such a case, the attachment position of the second strip were not provided, special time-consuming measures would be necessary to secure the corresponding side of the slab.

For connection with the rod surface on land, end sections of the type as shown in FIGS. 2 and 3 are normally used, and they have parts facing the bridge and corresponding to the side portions of the slabs. Each end section thus comprises a portion provided with a tongue 8' or and groove 9', an otherwise inclined side wall and a strip provided with a channel 14' or 15'. When an end section with a groove 9' has been fixed in position, which occurs in that attachment members 16 are positioned such that their ridges 20 are fitted in the channel 15', whereupon screws 24 are inserted and firmly tightened, the end section is rigidly pressed against the underlying structural beams 25. Cylindrical holes 26 of a size adapted exactly to the screw diameter are prebored in the beams.

The first bridge deck slab is then positioned against the beams 25 and is manually inserted as far as possible towards the end section, whereupon the attachment members 16 are mounted in the manner described above along the bottom edge which, as seen from the end section, constitutes the farther bottom edge of the deck slabs, and the screws 24 are tightened provisionally. Subsequently, a misfit, if any, e.g. because the slab is bent, can be adjusted. Such adjustment may be carried out by driving a thin wedge into the free space between the bottom surface of the attachment member 16 and the beam, between the shank of the screw and the strip 13 of the slab, until the tongue 8 fits perfectly in the groove 9'. Then the screw joints 24 are completely tightened to prevent any play between the bottom edge of the slab and the beam. The remaining bridge slabs are mounted and adjusted similarly, until the entire bridge deck is finished and, lastly, the other end section is mounted. Individual bridge deck slabs can be replaced, without necessitating dismounting of the entire bridge deck up to one end thereof. Since the tongue and groove have been given the shape illustrated, with a rounded nose portion of the tongue and rounded transitions between the groove and adjacent surface portions, the bridge deck slabs can be raised in the joint area and be easily tilted up and removed, after the attachment members have been loosened from below. Re-mounting is effected in the reverse order in that the tongue and groove of the new slabs are fitted in the groove and tongue of the remaining slabs which are held upwardly inclined towards each other and are then pressed down while fitting their tongue and groove. Instead of the above-mentioned wedging, other auxiliary means, e.g. hydraulic jacks or the like, can of course be used, which during clamping keep the slabs in engagement with each other by bolting.

Figure 7:
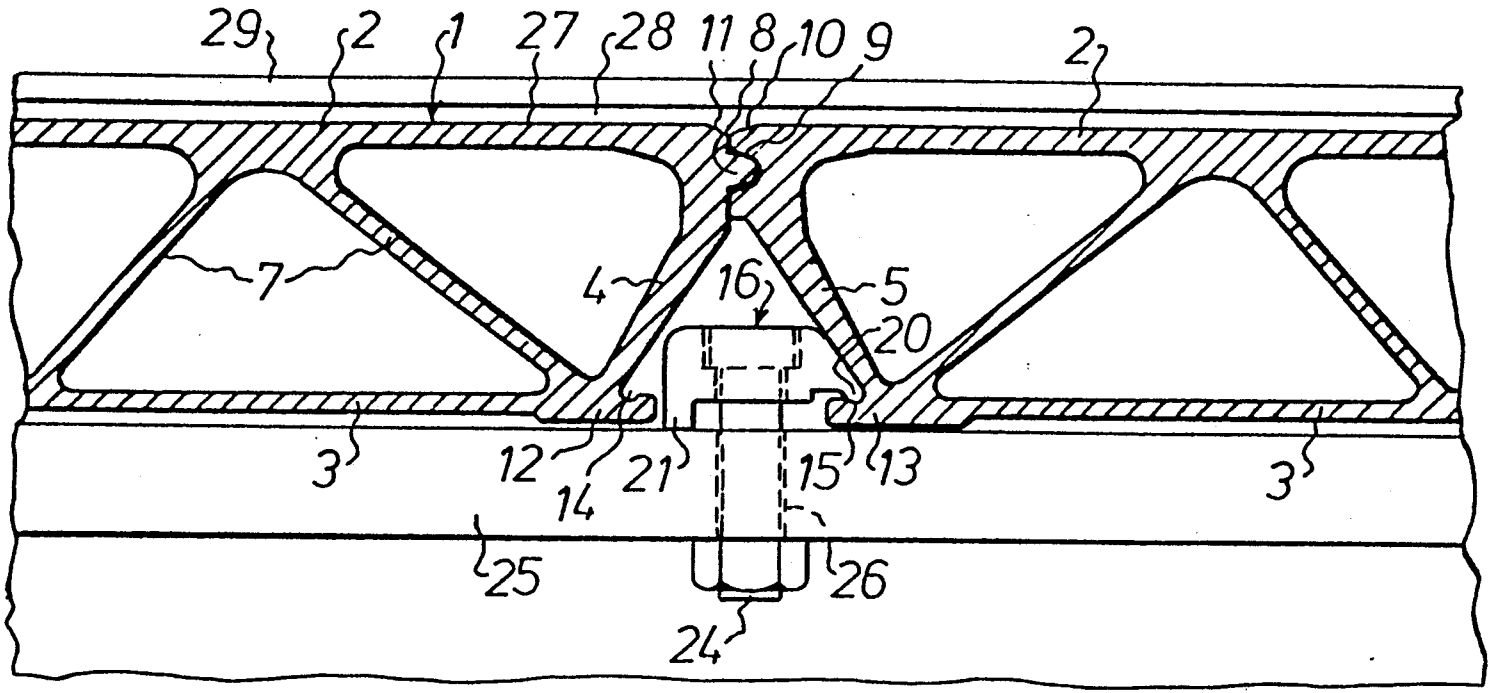
FIG. 7 is a cross-sectional view of a portion of a mounted bridge deck and its coating.

The bridge deck according to the invention is, as mentioned above, especially advantageous when used together with a new surfacing which can be applied directly to the upper side of the bridge deck slabs. A portion of such a surfacing is indicated in FIG. 7 and consists of a thin layer of primer 27 applied directly to the upper side of th aluminium slabs, a membrane layer 28 of a few millimeters thickness, made of a pressure-distributing and pressure-receiving elastic or elastoplastic material, e.g. two-component acrylic plastic, and upon this a thicker coating layer or coating-supporting layer 29 of a harder acrylic plastic, preferably provided with embedded mineral grains of a wear-resisting material. The drawing shows how the levels 10, 11 close to the transition between two slabs renders the membrane layer thicker at this point, and thus this layer allows the more rigid layer to yield without breaking up.

One of the advantages of the bridge deck according to the invention is the low weight which, when the bridge deck is used on existing bridges, affords a pronounced extra load-bearing capacity. Owing to the low weight, the main supporting structure of new bridges can be made lighter and thus less expensive, which is illustrated by the following example:

A bridge having a span of 50 m and a width of 12 m yields a surface area of 600 $m^2$.

A light concrete slab weighs about 700 $kg/m^2$, whereas a deck according to the invention weighs about 50–60 $kp/m^2$.

It can be roughly estimated that equivalent traffic loads for which bridges are calculated today are two concentrated loads in the centre of the bridge, each weighing 50 Mp, plus steady traffic in two lanes having an intensity of 0.9 $Mp/m^2$.

The maximum bending moment between supports, caused by traffic loads on the entire bridge will be 1780 Mpm.

The concrete deck yields a moment of 2625 Mpm and the deck according to the invention 225 Mpm.

In all, the bending moment is thus 4405 Mpm in traditional structures and 2005 Mpm in a deck according to the invention. The main supporting structure including the foundation thus need support merely about half the load on a deck according to the invention as compared to the conventional design. Thus results, of course, in considerable cost-savings for the expensive main structure.

I claim:

1. An arrangement in a bridge deck and the like surface-forming structure to be subjected to mobile concentrated loads moving along said surface, said arrangement comprising:

a plurality of deck slabs supported by a base and anchored to said base by corresponding anchoring means, each deck slab including a lower wall, an upper wall extending substantially parallel to said lower wall and of greater side-to-side dimension than said lower wall such that opposite sides of said upper wall extend outwardly beyond corresponding sides of said lower wall, and a pair of sidewalls joining said opposite sides of said upper wall respectively to said corresponding sides of said lower wall, one of said sidewalls having a tongue projecting outwardly from an intermediate portion thereof, the other of said sidewalls having a groove formed in an intermediate portion thereof, said tongue and groove being disposed at slightly different heights of the respective sidewalls relative to said lower wall, wherein said deck slabs are arranged side-by-side in succession, with successive deck slabs being in tongue-in-groove engagement, and wherein the lower wall of each deck slab has a portion resting on said base at one of the tongue side and the groove side of the slab, is held freely space above said base at the other of said tongue side and said groove side by said tongue-in-groove engagement with the next slab in succession, and is fixedly anchored to said base at its resting portion by engagement of the corresponding anchoring means with the slab and said base near said one side of the slab.

2. An arrangement according to claim 1, wherein each deck slab is anchored to said base only at said one side thereof.

3. An arrangement according to claim 2, wherein said one side is the groove side of the deck slab.

4. An arrangement according to claim 1, wherein each deck slab further comprises a portion projecting outwardly from said lower wall at said one side of the deck slab, said projecting portion having an upwardly open channel formed in an upper side thereof outwardly adjacent to a junction of said lower wall and the sidewall at said one side of the deck slab, said projecting portion being anchored to said base by an attachment member of the corresponding anchoring means having an engagement portion engaged within said channel and by bolt means of said corresponding anchoring means securing said attachment member to said base.

5. An arrangement according to claim 4, wherein said attachment member includes a body portion having an inclined side portion in face-to-face abutment with the sidewall at said one side of the deck slab, said engagement portion of said attachment member being formed at a lower edge of said inclined side portion and being a complementary shape to said channel, said body portion further having a downward projection disposed at an opposite side portion thereof and in engagement with said base, said bolt means extending through a bore in said body portion.

6. An arrangement according to claim 5, wherein said attachment member engages said base only at said downward projection.

7. An arrangement according to claim 1, wherein said tongue has a rounded outer portion and upper and lower sides joined to said outer portion and converging toward said outer portion from a root portion of said tongue, and wherein said groove is of complementary shape to said tongue.

8. An arrangement according to claim 7, wherein said tongue and groove extend substantially parallel to said upper and lower walls.

9. An arrangement according to claim 1, wherein said opposite sides of said upper wall are beveled.

10. An arrangement according to claim 9, wherein a paving is arranged on upper surfaces of the respective upper walls of said deck slabs, said paving including a thin layer of primer, a membrane layer of pressure distributing and pressure receiving elastic material on said primer layer, and a layer of acrylic plastic on said membrane layer, said layer of acrylic plastic being harder than said membrane layer and having mineral grains of wear-resistant material embedded therein, said membrane layer being of increased thickness at adjacent beveled edges of successive deck slabs so as to allow smooth bending of said acrylic plastic layer near the tongue and groove joint between successive deck slabs.

11. An arrangement according to claim 10, wherein said membrane layer includes a two-component acrylic plastic.

12. An arrangement according to claim 4, wherein said sidewalls have respective portions which incline outwardly relative to the corresponding sides of said lower wall.

13. An arrangement according to claim 12, wherein said outwardly inclined portions join with said lower wall.

14. An arrangement according to claim 13, wherein each deck slab further includes inclined brace walls intermediate said sidewalls and joining said upper and lower walls to one another.

15. An arrangement according to claim 14, wherein said brace walls have rounded corners at their junctions with said upper and lower walls.

16. An arrangement according to claim 14, wherein said channel is positioned adjacent to a line of intersection of a center plane of said lower wall, a center plane of the inclined sidewall portion at said one side of the deck slab, and a center plane of a brace wall.

17. An arrangement according to claim 16, wherein each deck slab and attachment member are made of light metal.

18. An arrangement according to claim 17, wherein said light metal is aluminum.

19. An arrangement according to claim 6, wherein said bore is non-circular and shaped to permit adjustment of said attachment member relative to said bolt means along said base prior to final tightening of said bolt means.

* * * * *